US007163375B2

(12) United States Patent
Queriault et al.

(10) Patent No.: US 7,163,375 B2
(45) Date of Patent: Jan. 16, 2007

(54) LIGHTENED INTERBLADE PLATFORM FOR A TURBOJET BLADE SUPPORT DISC

(75) Inventors: Michele Jacqueline Queriault, Melun (FR); Claude Robert Louis Lejars, Draveil (FR)

(73) Assignee: Snecma Moteurs, Paris (FR)

( * ) Notice: Subject to any disclaimer, the term of this patent is extended or adjusted under 35 U.S.C. 154(b) by 29 days.

(21) Appl. No.: 10/893,272

(22) Filed: Jul. 19, 2004

(65) Prior Publication Data

US 2005/0276692 A1 Dec. 15, 2005

(30) Foreign Application Priority Data

Jul. 31, 2003 (FR) ..... 03 09452

(51) Int. Cl.
*F01D 5/22* (2006.01)
*F03B 1/04* (2006.01)

(52) U.S. Cl. ..... 416/193 A; 416/219 R; 416/245 R; 416/248

(58) Field of Classification Search ..... 416/204 A, 416/244 R, 244 A, 245 R, 94, 198 A, 248, 416/219 R, 220 R, 221, 193 A, 243
See application file for complete search history.

(56) References Cited

U.S. PATENT DOCUMENTS 3,455,537 A * 7/1969 Ciavola et al. ..... 416/220 R
4,621,979 A 11/1986 Zipps et al.
5,277,548 A 1/1994 Klein et al.
6,447,250 B1 * 9/2002 Corrigan et al. ..... 416/193 A

FOREIGN PATENT DOCUMENTS

EP 0 677 645 A1 10/1995

* cited by examiner

*Primary Examiner*—Igor Kershteyn
(74) *Attorney, Agent, or Firm*—Oblon, Spivak, McClelland, Maier & Neustadt, P.C.

(57) ABSTRACT

An interblade platform for a blade support disc on a turbojet blower includes a deflecting part with a lower face provided with a first fixing lug provided with a first orifice for the passage of a first fixing stud and a second fixing lug provided with second and third orifices for the passage of second and third fixing studs. The fixing studs are intended to fix the two fixing lugs to the support disc between two adjacent blades.

15 Claims, 2 Drawing Sheets

LIGHTENED INTERBLADE PLATFORM FOR A TURBOJET BLADE SUPPORT DISC

BACKGROUND OF THE INVENTION

1 Field of the Invention

The invention relates to the field of turbojets, more particularly that of interblade platforms for the blade support discs for turbojet blowers.

2 Description of the Related Art

Turbojet blowers (or fans), whose blades have a curved end, generally comprise blade support discs equipped with attached interblade platforms intended to optimize the flow of air between the blades, and more precisely to reconstitute the aerodynamic profile of the internal "stream" at the blades.

These attached platforms comprise a deflecting part whose lower face frequently comprises three fixing lugs (one upstream, one central and one downstream) intended to enable them to be fixed isostatically to a support disc. Two embodiments are normally encountered. The first embodiment consists of arranging the three fixing lugs in the form of flanges provided with an orifice for the passage of a fixing stud. The second embodiment consists of arranging two of the three fixing lugs in the form of flanges provided with an orifice for the passage of the fixing stud, and providing the third fixing lug with a fixing device of the bayonet type.

The attached platforms generally being metallic or composite, their three fixing lugs are formed by machining from a solid block. However, because of the presence of the upstream and downstream fixing lugs, accessibility to the central fixing lug is difficult, which makes it particularly tricky to machine. In addition, because of the presence of three fixing lugs the weight of the platforms is relatively great, which contributes to making the turbojets which they equip heavier.

In addition, when an incident occurs on a blade, for example because of the ingestion of a foreign body by the turbojet, the blade may move (or flex) and interfere with the lateral edge of one of the adjoining platforms. However, because of the method of fixing the platforms, when such an interference occurs, the said platforms deform whilst remaining substantially in place, which may cause significant damage at the blade, or even in the engine part of the turbojet situated downstream of the blades, and/or a loss of efficiency of the turbojet, or even cause it to be put out of service.

SUMMARY OF THE INVENTION

The aim of the invention is to improve the situation.

To this end, it proposes an interblade platform for a blade support disc in a turbojet blower, comprising a deflecting part comprising a lower face provided with a first fixing lug provided with a first orifice for the passage of a first fixing stud, and a second fixing lug provided with second and third orifices for the passage of second and third fixing studs, these fixing studs being intended to fix the two fixing lugs (or flanges) to the support disc between two adjacent blades.

Thus, using no more than two fixing lugs, firstly the machining operations are appreciably facilitated and secondly the weight of the platforms is substantially reduced. Isostatism is nevertheless preserved because of the fixing of the platform by means of three fixing studs.

In a particularly advantageous embodiment, the first and second orifices can be placed in the first and second fixing lugs substantially opposite each other, so that the first and second fixing studs are substantially aligned along the same axis.

In this way, in the event of rupture of the third fixing stud, under the impact of a blade (or any other force, in particular centrifugal), the platform can be driven in rotation about the axis defined by the other two fixing studs. This makes it possible to release space for the stressed blade and to prevent the platform being the subject of deformation harmful both to the adjoining blades and to performance.

Moreover, in order to promote rupture of the third fixing stud in the case of an incident, the third fixing stud can have a resistance to strain less than that of the first and second fixing lugs. To do this, the cross-sections of the first and second fixing studs can be greater than that of the third fixing stud and/or their materials may be different.

Such a platform may be produced from a metallic or composite material.

The invention also relates to a blade support disc comprising a multiplicity of interblade platforms of the type presented above and respectively interposed between adjacent pairs of blades.

BRIEF DESCRIPTION OF THE DRAWINGS

Other characteristics and advantages of the invention will emerge from an examination of the following detailed description, and the accompanying drawings, in which.

DETAILED DESCRIPTION OF THE PREFERRED EMBODIMENTS

The accompanying drawings cannot only serve to supplement the invention but also help its definition, where necessary.

The invention relates to an interblade platform intended to equip a blade support disc for a turbojet blower (or fan) equipped with blades with a curved end (also referred to as "wide chord" blades).

Figure 1:
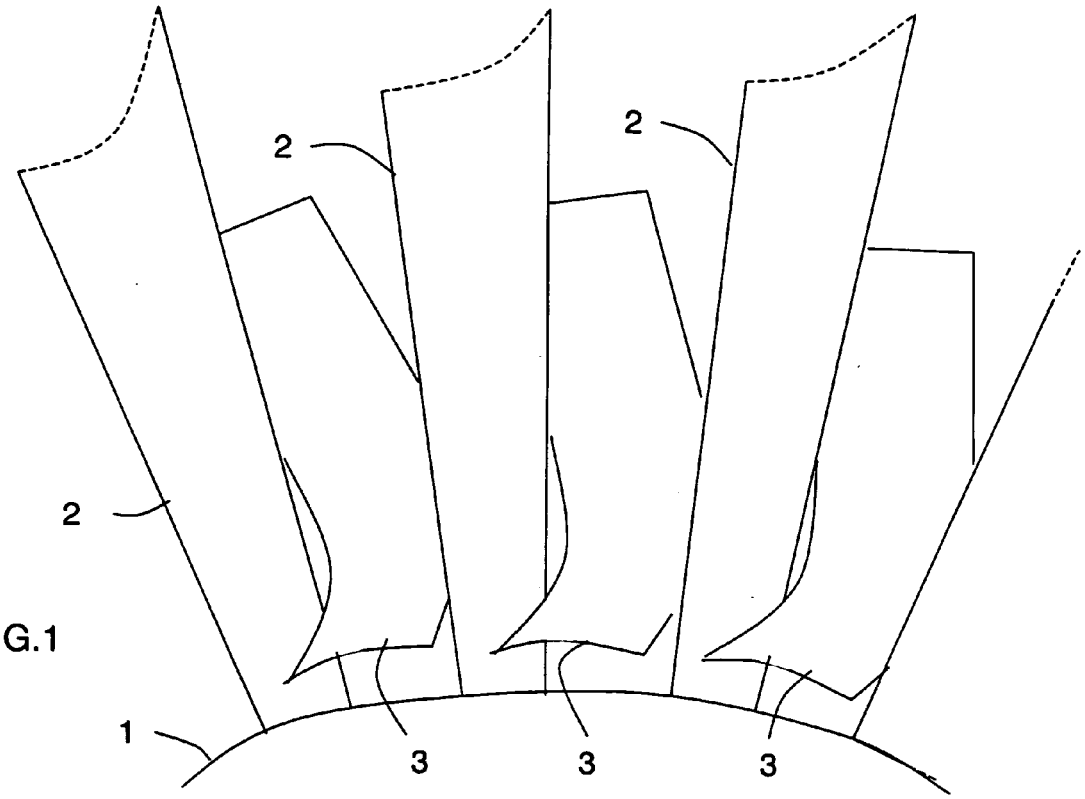
FIG. 1 illustrates schematically part of a blade support disc in a front view.

As is partially illustrated in FIG. 1, a blade support disc 1 is an element of a blower (not shown), which is mounted on a rotor shaft and on which there are fixed a multiplicity of blades 2, with a curved end, and a multiplicity of attached interblade platforms 3, preferably metallic (for example, made from aluminum). More precisely, each attached platform 3 is installed on the support disc 1, between two adjacent blades 2 so as to reconstitute the aerodynamic profile of the internal "stream" at the blades.

Figure 2:
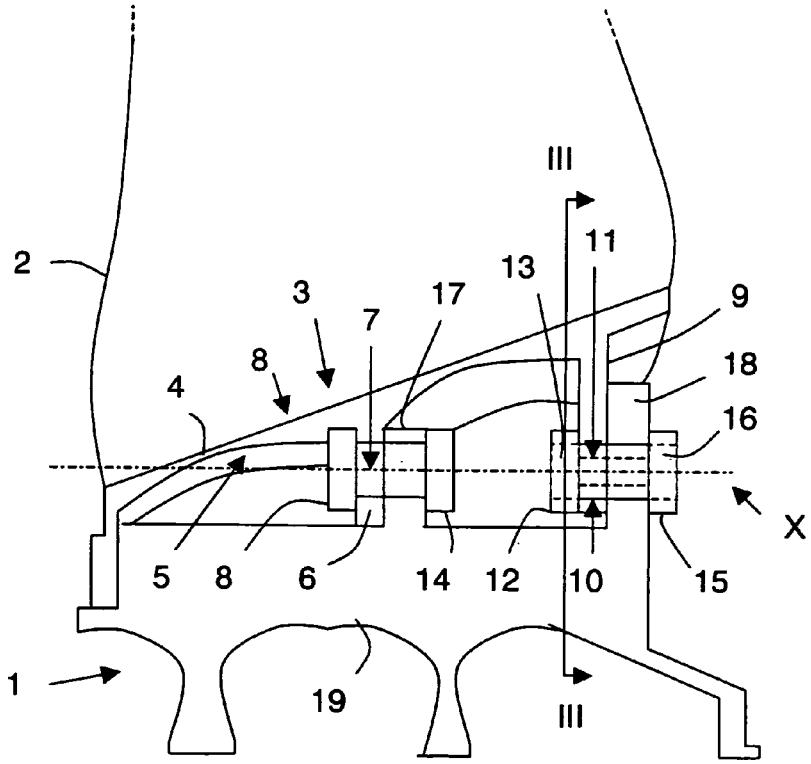
FIG. 2 illustrates schematically, in an offset transverse section view, an embodiment of an interblade platform according to the invention.
Figure 3:
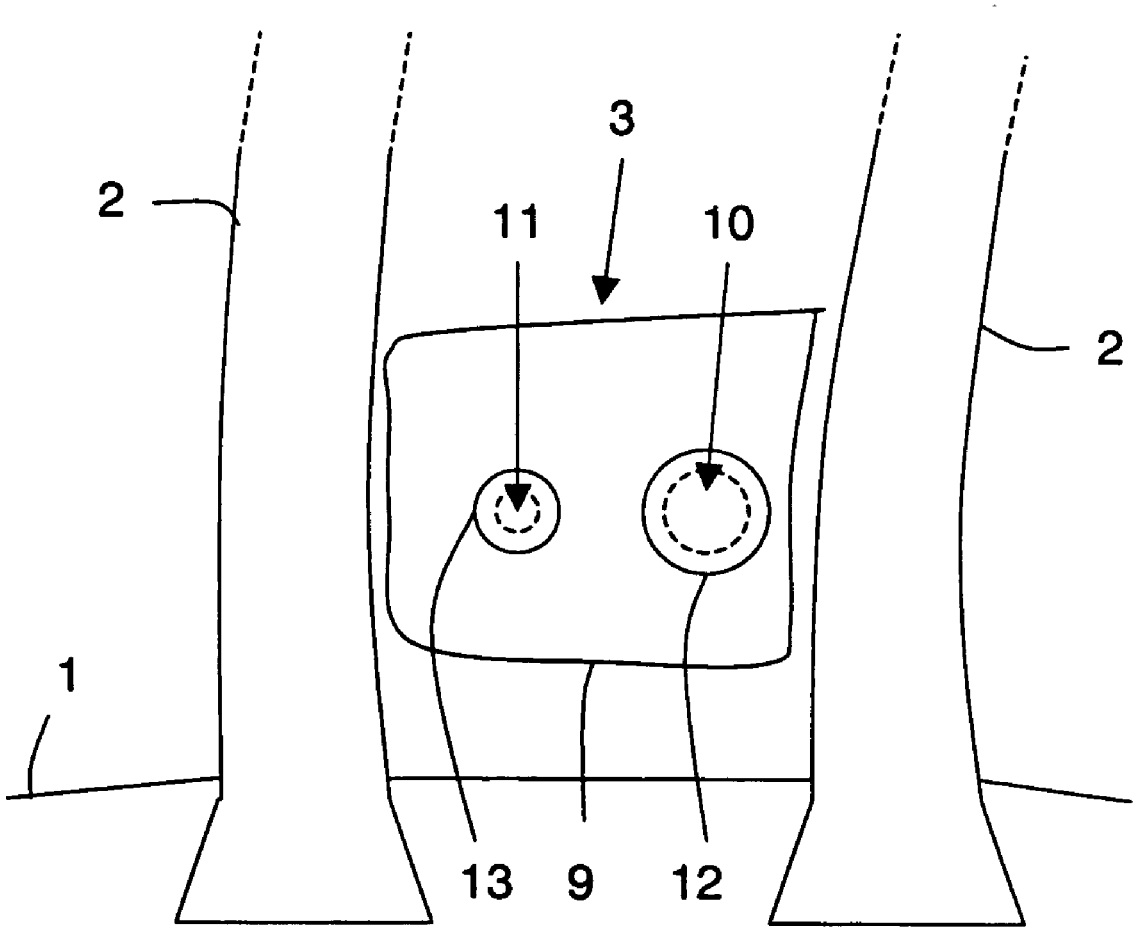
FIG. 3 is a view in section along the axis III—III in FIG. 2, of an interblade platform according to the invention illustrating an exemplary embodiment of a fixing lug with two orifices.

As is illustrated in FIGS. 2 and 3, each platform 3, according to the invention, comprises a deflecting part 4 comprising a lower face 5 provided with a first fixing lug (or flange) 6 provided with a first orifice 7 for the passage of a first fixing stud 8, and a second fixing lug (or flange) 9, provided with second 10 and third 11 orifices for the passage of second 12 and third 13 fixing studs.

Preferentially, and as illustrated, the second 10 and third 11 orifices are placed alongside each other, substantially at the same level, so that the third stud 13 remains as little stressed as possible. However, they could also be placed one above the other or offset laterally or in height.

The fixing studs 8, 12 and 13 are preferentially of the shouldered and threaded type. They each comprise a shank, one end of which is provided with a shouldered head and the other end with a thread cooperating with a nut 14, 15 or 16, so as to immobilize the corresponding fixing lug 6 or 9 on one of the fixing lugs 17 or 18 of an element 19 of the support disc 1. In other words, the first fixing stud 8 is intended to immobilize the first fixing lug 6 on the fixing lug 17 of the element 19, and the second 12 and third 13 fixing studs are intended to immobilize the second fixing lug 9 on the fixing lug 18 of the said element 19.

Thus, by using two fixing lugs 6 and 9 and three fixing studs 8, 12 and 13, isostatism is complied with.

In a particularly advantageous embodiment illustrated in FIG. 2, the first orifice 7 and the second orifice 10 are placed in the first 6 and second 9 fixing lugs, substantially opposite each other, so that the first 8 and second 12 fixing lugs are substantially aligned along the same axis X.

By virtue of this particular arrangement, when the third fixing lug 13 breaks, for example because of a centrifugal force under the impact of a blade 2 subject to a stress, the platform 3 can pivot about the axis X defined by the alignment of the two fixing studs 8 and 12. The released platform 3 can then follow the movements of the blades stressed (or afflicted) by events, so that the assembly regains a new equilibrium position, the platform 3 in fact being able to bear on a blade flank 2 up to a certain point (beyond a certain movement there is a rupture effect on the platform and studs).

Thus, the platform 3 is little or not deformed, which guarantees a scarcely modified aerodynamic flow, but in particular it remains entirely in place, which prevents its being ingested by the turbojet engine. In addition, the third broken fixing stud 13 remains captive in the "chamber" delimited by the platform 3, so that it does not risk damaging elements situated to the rear of the blower. In addition, this rotation of the platform 3 leaves space for the blade 2 which has moved under the effect of the force, which prevents it being seriously damaged.

In order to promote rupture of the third fixing stud 13 in the event of incident, the latter can either have dimensions identical to those of the first 8 and second 12 fixing studs but a resistance to stress less than theirs, or have a cross-section less than that of the first 8 and second 12 fixing studs. The latter solution is illustrated in FIG. 2.

More precisely, in the example illustrated in FIG. 2, the first 7 and second 10 orifices have dimensions which are substantially identical but greater than those of the first orifice 11 in order to receive first 8 and second 12 fixing studs whose cross-section is greater than that of the third fixing stud 13.

It can also be envisaged using a third fixing stud 13 having both a strength and a cross-section less than those of the first 8 and second 12 fixing studs.

In these variant embodiments with a third "breakable" fixing stud 13, the first 8 and second 12 fixing studs therefore withstand the centrifugal forces, whilst the said third fixing stud 13 serves in normal operation to provide the isostatism of the platform 3 and in abnormal operation to trigger, in the event of rupture, the pivoting of the said platform 3.

The invention is not limited to the interblade platform and blade support disc embodiments described above, solely by way of example, but encompasses all variants which may be envisaged by a person skilled in the art in the context of the following claims.

Thus, a platform has been described in which the first fixing lug, the least high and comprising a single orifice intended to receive a stud, being placed upstream of the second fixing lug, the highest and comprising two orifices intended each to receive a stud. However, the converse can be envisaged, the first lug then being the highest, still comprising a single orifice intended to receive a stud, and being placed downstream of the second fixing lug, the least high and still comprising two orifices intended each to receive a stud.

The invention claimed is:

1. An interblade platform for a disc supporting blades on a turbojet blower, said platform comprising:

a deflecting part comprising a lower face provided with a first fixing lug provided with a first orifice for the passage of a first fixing stud, and a second fixing lug provided with second and third orifices for the passage of second and third fixing studs, said fixing studs being configured to fix said first and second fixing lugs to said support disc between two adjacent blades, wherein said first and second orifices are placed in said first and second fixing lugs substantially opposite each other, so that said first and second fixing studs are substantially aligned on a same axis.

2. A platform as claimed in claim 1, wherein said third fixing stud has a resistance to stresses less than that of said first and second fixing studs.

3. A platform as claimed in claim 2, wherein said first and second orifices have substantially identical dimensions and are able to receive the first and second fixing studs having a first cross-section, and wherein said third orifice has dimensions substantially less than those of said first and second orifices so as to receive the third fixing stud having a second cross-section less than said first cross-section.

4. A platform as claimed in claim 2, wherein said third fixing stud is formed with a material whose resistance to stresses is less than that of materials of said first and second fixing studs.

5. A platform as claimed in claim 1, wherein said second and third orifices of the second fixing lug are placed alongside each other, substantially at a same level.

6. A platform as claimed in claim 1, wherein said platform is formed with a metallic material.

7. A platform as claimed in claim 1, wherein said platform is formed with a composite material.

8. A blade support disc, comprising a multiplicity of interblade platforms according to claim 1, respectively interposed between adjacent pairs of blades.

9. An interblade platform as claimed in claim 1, wherein said lower face of said deflecting part is free of any additional fixing lugs configured to be fixed to said disk beyond said first and second fixing lugs.

10. An interblade platform as claimed in claim 1, wherein said first and second lugs are fixed isostatically to said disk by said first, second and third studs.

11. An interblade platform as claimed in claim 1, wherein said platform and said first and second fixing lugs are configured such that, when said third fixing stud ruptures, said platform is rotatable around an axis.

12. An interblade platform as claimed in claim 1, wherein said platform and said first and second fixing lugs are configured such that, when said third fixing stud ruptures, said platform is rotatable around said same axis.

13. An interblade platform as claimed in claim 12, wherein said third fixing stud has a resistance to stresses less than that of said first and second fixing studs.

14. An interblade platform as claimed in claim 1, wherein said platform is free of any additional fixing studs configured to fix said platform to said disk beyond said first, second and third fixing studs.

15. An interblade platform as claimed in claim 9, wherein said platform is free of any additional fixing studs configured to fix said platform to said disk beyond said first, second and third fixing studs.

* * * * *